US008979113B1

(12) United States Patent
Rossi et al.

(10) Patent No.: US 8,979,113 B1
(45) Date of Patent: Mar. 17, 2015

(54) COMBINATION CARRYING STRAP AND TETHER FOR SNOWBOARDS

(76) Inventors: Domenico Rossi, Binghamton, NY (US); Steve Mattson, Binghamton, NY (US)

( * ) Notice: Subject to any disclaimer, the term of this patent is extended or adjusted under 35 U.S.C. 154(b) by 0 days.

(21) Appl. No.: 10/602,834

(22) Filed: Jun. 24, 2003

(51) Int. Cl.
*A63C 9/00* (2012.01)

(52) U.S. Cl.
USPC ..... 280/637; 280/14.21; 280/14.22; 280/809

(58) Field of Classification Search
USPC ..... 280/809, 637, 633, 621, 814, 816, 280/14.21, 14.22; 70/18, 14, 58
See application file for complete search history.

(56) References Cited

U.S. PATENT DOCUMENTS 2,933,324 A * 4/1960 Stimler ..... 280/637
3,611,760 A * 10/1971 Muther ..... 70/18
3,670,535 A * 6/1972 Stettner et al. ..... 70/58
3,826,510 A * 7/1974 Halter ..... 280/809
4,098,099 A * 7/1978 Smith ..... 70/18
4,685,697 A * 8/1987 Thorley ..... 280/637
5,026,088 A * 6/1991 Stuart ..... 280/637
5,857,682 A 1/1999 Hyman
5,902,164 A 5/1999 Shoemaker
5,904,056 A 5/1999 Ozaki
6,053,381 A 4/2000 Fahl et al.
6,192,719 B1 2/2001 Stukas et al.
6,374,645 B1 4/2002 Fontes et al.

* cited by examiner

*Primary Examiner* — Hau Phan
(74) *Attorney, Agent, or Firm* — Matthew M. Hulihan, Esq.; Heslin Rothenberg Farley & Mesiti, P.C.

(57) ABSTRACT

A combination device is featured for both tethering a snowboard to the boot of a user and for carrying a snowboard over the shoulder. The device has a retraction unit that houses a spring-wound strap within. The retractable unit has a flange for attaching the unit to one of the bindings of the snowboard. Screws are used to affix the flange, and hence the retraction unit, to the binding. The combination tether and carrying strap is easily accessible by pulling on the hooking latch, which is attached to the retractable strap.

8 Claims, 3 Drawing Sheets

COMBINATION CARRYING STRAP AND TETHER FOR SNOWBOARDS

FIELD OF THE INVENTION

The invention pertains to snowboards and, more particularly, to a combination retractable carrying strap and tether for snowboards that attaches to the bindings thereof.

BACKGROUND OF THE INVENTION

In recent times, snowboarding has become very popular among snow sport enthusiasts. Ski and snowboard resorts require snowboards to have a tether that is attachable to the boot. This is necessary to prevent the board from sailing out of control down the mountain during a fall or mishap. It is also common to observe that many snowboards feature a carrying strap, which slings about the shoulder of the user.

The present invention seeks to combine a tether and carrying strap into a single, retractable unit, which attaches to the binding of a snowboard. The retractable unit is provided with a mounting bracket, which is easily mountable to one of the bindings of a snowboard by means of a single screw, or a plurality of screws. Most bindings have screw holes for this purpose.

The combination tether and carrying strap is easily accessible by pulling on the hooking latch, which is attached to the retractable strap. The required length of strap is withdrawn from its receptacle unit. The hooking latch is attached to the laces of the boot or to a key ring attached to the laces of the boot in the tether mode, or it is attached to the other binding in the snowboard-carrying mode. In the snowboard-carrying mode, the attached strap is slung over the shoulder of the user.

DISCUSSION OF RELATED ART

Retractable tether mechanisms are illustrated in U.S. Pat. No. 5,857,682, issued to Jeffrey N. Hyman on Jan. 12, 1999 for SNOWBOARD STORAGE COMPARTMENT; U.S. Pat. No. 5,902,164, issued to Michael J. Shoemaker on May 11, 1999 for RETRACTABLE SURFBOARD LEASH; U.S. Pat. No. 5,904,056, issued to Ron Ozaki on May 18, 1999 for COMBINATION TETHER AND LOCKING DEVICE; U.S. Pat. No. 6,053,381, issued to Fahl et al. on Apr. 25, 2000 for RETRACTABLE SHOULDER STRAP BACKPACK; U.S. Pat. No. 6,192,719, issued to Stukas et al. on Feb. 27, 2001 for SNOWBOARD LOCKING DEVICE.

U.S. Pat. No. 5,026,088, issued Jun. 25, 1991 to Stuart, discloses a safety strap of the invention includes a fastener which is secured to a snowboard, and a length of cable, having a loop at each end thereof. One of the loops is secured to the fastener while the other end has an attachment device secured to it. A leg strap is worn by a snowboard user. The strap is secured about the user's leg and has a connection thereon for receiving the attachment device at the other end of the cable.

U.S. Pat. No. 6,374,645, issued Apr. 23, 2002 to Fontes, discloses a relatively simple locking device for sporting items such as skateboards, snowboards, snow skis, and the like. In one form of the locking device, the same includes a member which can be affixed to a wheel truck of a skateboard, binding of a snowboard, or binding of a snow ski, and includes a releasable cable which can be wrapped around a fixed or stationary object so as to secure the sporting item. In one embodiment, the cable can be extended and retracted from the body of the locking device.

None of these patents, however, teach the attachment of a retractable strap contained within a unit that is affixed to a snowboard binding for the purposes of both tethering and for carrying the snowboard.

SUMMARY OF THE INVENTION

In accordance with the present invention, a snowboard device is featured providing a safety tether and carrying strap combination. The device comprises a retraction unit that contains a spring-wound strap within its housing. The retractable unit has a flange for attaching the unit to one of the bindings of the snowboard. A screw or a plurality of screws is used to affix the flange, and hence the retraction unit, to the binding.

The combination tether and carrying strap is easily accessible by pulling on the hooking latch, which is attached to the retractable strap. A required length of the strap is withdrawn from its receptacle unit. The hooking latch is attached to the laces of the boot or to a key ring, which is attached to the laces of the boot in the tether mode, or it is attached to the other binding in the snowboard-carrying mode. In the snowboard-carrying mode, the attached strap is slung over the shoulder of the user.

An advantage of the present invention is to provide a combination tether and carrying strap for a snowboard.

It is another advantage to provide an improved tethering device for a snowboard.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components and elements of the apparatus of this invention will bear the same designations or numbering throughout the figures.

DESCRIPTION OF THE PREFERRED EMBODIMENT

Generally speaking, a combination device is featured for both tethering a snowboard to the boot of a user and for carrying the snowboard over the shoulder. The device comprises a retraction unit that contains a spring-wound strap within its housing. The retractable unit has a flange for attaching the unit to one of the bindings of the snowboard. A screw or a plurality of screws is used to affix the flange and, hence the retraction unit, to the binding. The combination tether and carrying strap is easily accessible by pulling on the hooking latch, which is attached to the retractable strap.

Figure 1:
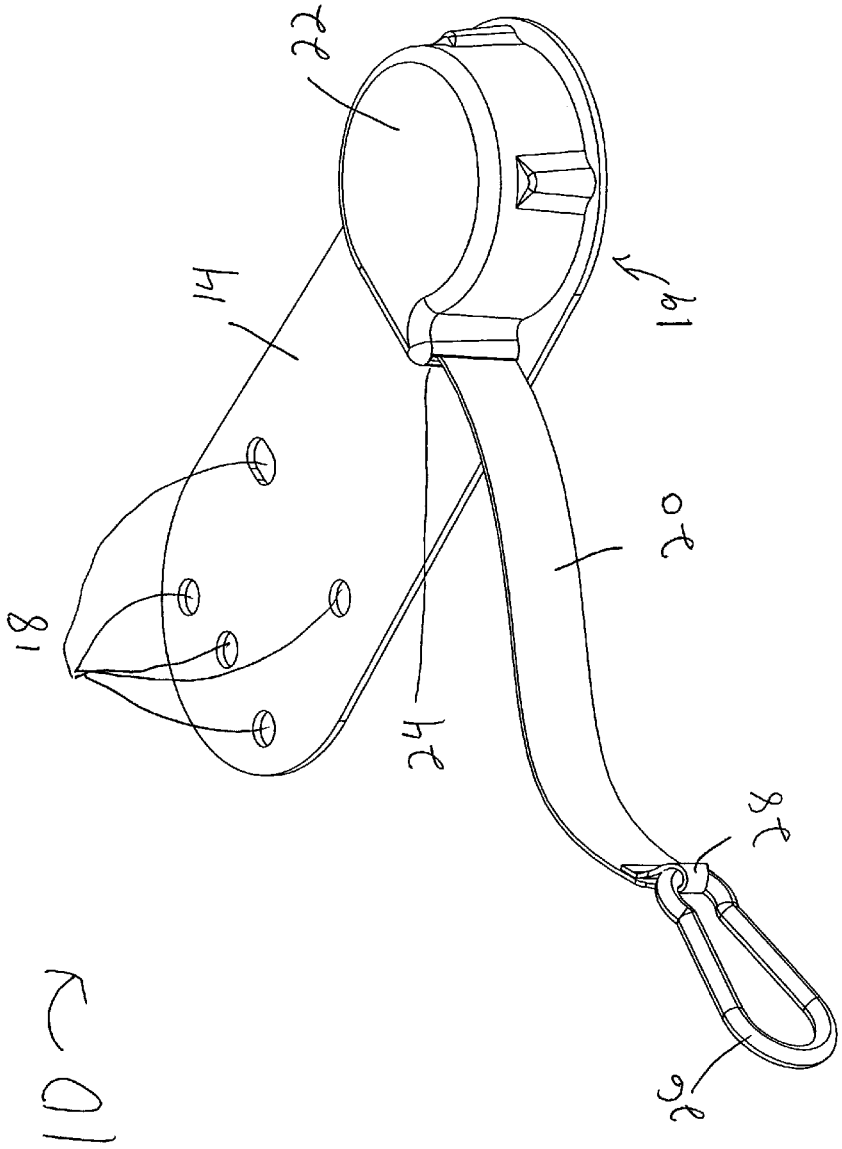
FIG. 1 illustrates a three-dimensional perspective view of the combination tether and snowboard-carrying device.
Figure 2:
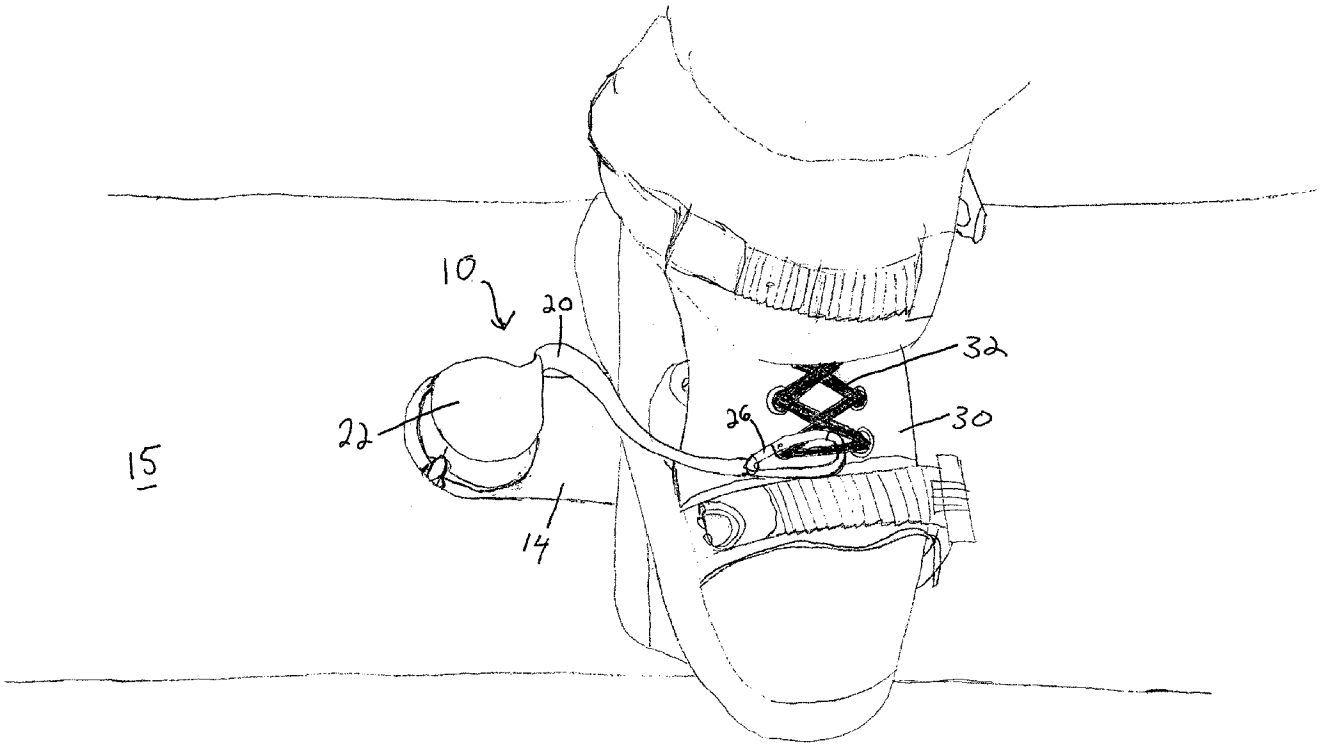
FIG. 2 depicts an enlarged, in situ view of one of the bindings of the snowboard shown in FIG. 1, with a boot disposed therein, and the retractable unit of this invention affixed thereto as a tethering means.
Figure 3:
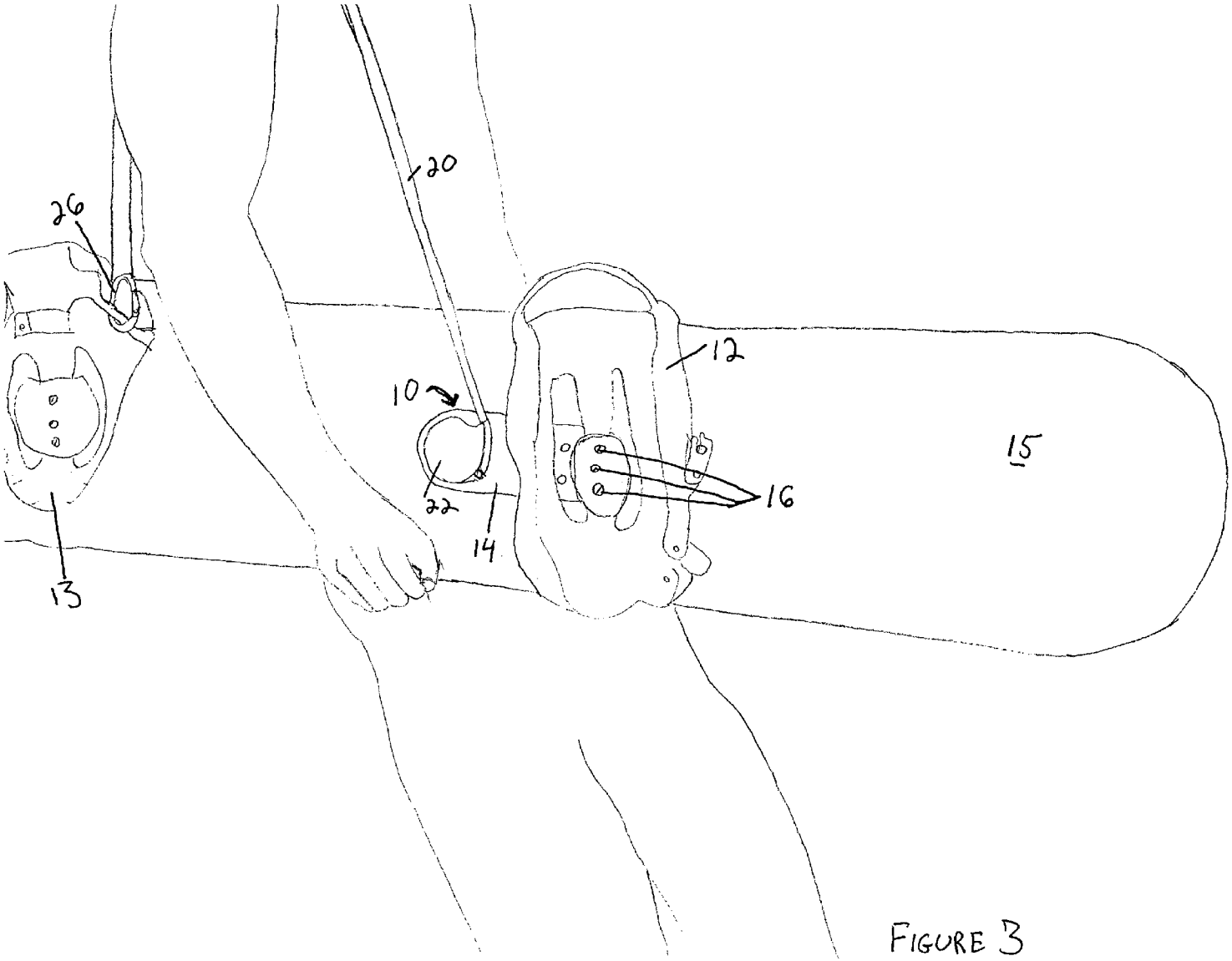
FIG. 3 shows an in situ view of a snowboard user carrying the snowboard using the tether-carrying strap device of this invention.

Now referring to FIG. 1, the retractable strap device of this invention, generally referred to as 10, is shown. The retractable strap device 10 is affixed to the binding 12 of snowboard 15 by means of a flange 14 and securing screws 16 that fit into one or more screw holes 18, as better observed with reference to FIG. 3. The retractable strap device 10 comprises a strap 20, measuring ¾" wide×43" long, that is spring-biased in a wound position within the housing 22 and extends from an opening 24 in said housing 22, as illustrated. A snap-hook 26 is attached to the distal end 28 of the strap 20, for connection to either a boot 30 or to the opposite binding 13, as shown in FIGS. 2 and 3 respectively.

In the tethering mode, the strap 20 is attached to the boot 30 of a user. The snap-hook 26 attaches the strap 20 to the boot 30 by hooking onto the laces 32 of the boot 30 as illustrated in FIG. 2. The snap-hook 26 can also be hooked onto a key ring (not shown), which is looped around the laces 32 of boot 30. In the snowboard-carrying mode, the snap-hook 26 may be secured to the opposite binding 13, as illustrated in FIG. 3.

The retractable unit 19 comprises the housing 22, the strap 20 and an internal spring (not shown). The housing 22 contains the wound strap (not shown), and has an internal spring that biases the strap 20 to maintain a wound position and for retractably retrieving the strap 20 when extended from the housing 22. The strap 20 can made of woven nylon mesh, and the snap-hook 26 can be made of metal or plastic.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A retractable combination carrying strap and tether device for a snowboard, comprising:

a) a flexible, spring-wound carrying strap and tether having a proximal end and a distal, free end, said flexible carrying strap and tether being movable between a retracted, stowed position and an extended position;

b) a retracting mechanism operably attached to said proximal end of said carrying strap and tether for maintaining said carrying strap and tether in said stowed position, and for retractably retrieving said distal, free end thereof from said extended position whereby said carrying strap and tether can be disengaged without separating said retracting mechanism from said snowboard;

c) a housing surrounding and containing said retracting mechanism, said distal, free end of said tether and carrying strap being disposed outside said housing when said tether and carrying strap is disposed in said stowed position; and d) a flange operatively disposed upon said housing for attaching said housing beneath a first binding of said snowboard using existing binding mounting holes therein, wherein the carrying strap and tether removably attaches said distal end of said carrying strap and tether directly to a boot and forms a tether configuration, and wherein the carrying strap and tether further removably attaches said distal end of said carrying strap and tether to a second binding of said snowboard, which is a separate binding from the first binding of the snowboard, thereby forming a carrying strap configuration.

2. The combination carrying strap and tether device in accordance with claim 1, wherein said carrying strap and tether comprises a snap-hook to removably attach the distal end of the carrying strap and tether around laces of the boot.

3. The combination carrying strap and tether device in accordance with claim 2, wherein said snap-hook comprises at least one of the materials: metal, and plastic.

4. The retractable combination carrying strap and tether device of claim 2, wherein said snap-hook comprises a discontinuous state and provides removable attachment of said distal end of the carrying strap and tether securely and directly to said boot and said second binding.

5. The combination carrying strap and tether device in accordance with claim 1, wherein said carrying strap and tether comprises a woven nylon mesh material for retractably retrieving said strap as a carrying device.

6. A snowboard comprising:

a) a first boot binding and a second boot binding which is separate from the first boot binding;

b) a housing containing a strap and a retracting mechanism for maintaining said strap in a wound position, and for retractably retrieving the strap when it is extended from the housing whereby said strap can be disengaged without separating said retracting mechanism from said snowboard; and c) a flange operatively disposed upon the housing for attaching the housing to said first boot binding, wherein the strap comprises a snap-hook disposed on a distal end of said strap, wherein the snap-hook removably attaches directly to a boot secured to the snowboard by the first boot binding, wherein attachment of the snap-hook directly to the boot facilitates maintaining control of the snowboard by a user thereof, and wherein the snap-hook removably attaches to the second binding of said snowboard, thereby forming a carrying strap configuration.

7. A retractable combination carrying strap and tether device for a snowboard, comprising:

a) a flexible, spring-wound carrying strap and tether being approximately ¾" wide and 43" long and having a proximal end and a distal, free end, said flexible carrying strap and tether being movable between a retracted, stowed position and an extended position;

b) a retracting mechanism operably attached to said proximal end of said carrying strap and tether for maintaining said carrying strap and tether in said stowed position, and for retractably retrieving said distal, free end thereof from said extended position whereby said carrying strap and tether can be disengaged without separating said retracting mechanism from said snowboard;

c) a housing surrounding and containing said retracting mechanism, said distal, free end of said tether and said carrying strap being disposed outside said housing when said tether and said carrying strap are disposed in said stowed position; and d) a flange operatively disposed upon said housing for attaching said housing beneath a first binding of said snowboard using existing binding mounting holes therein, wherein the carrying strap and tether removably attaches said distal end of said carrying strap and tether directly to a boot and forms a tether configuration, and wherein the carrying strap and tether further removably attaches said distal end of said carrying strap and tether to a second binding of said snowboard, which is a separate binding from the first binding of the snowboard, thereby forming a carrying strap configuration.

8. A snowboard comprising:

a) a first boot binding and a second boot binding which is separate from the first boot binding;

b) a housing containing a strap and a retracting mechanism for maintaining said strap in a wound position, and for retractably retrieving the strap when it is extended from the housing whereby said strap can be disengaged without separating said retracting mechanism from said snowboard; and c) a flange operatively disposed upon the housing for attaching the housing to said first boot binding, wherein the strap comprises a snap-hook disposed on a distal end of said strap, wherein the snap-hook removably attaches directly to the second boot binding, wherein attachment of the snap-hook directly to the second boot binding facilitates carrying the snowboard by a user, and wherein the snap-hook removably attaches to the second binding of said snowboard, thereby forming a carrying strap configuration.

* * * * *